US011305533B2

(12) United States Patent
Naito et al.

(10) Patent No.: US 11,305,533 B2
(45) **Date of Patent: *Apr. 19, 2022**

(54) LIQUID DISCHARGE APPARATUS AND METHOD FOR MANUFACTURING THE SAME

(71) Applicant: Brother Kogyo Kabushiki Kaisha, Nagoya (JP)

(72) Inventors: Kyohei Naito, Nagoya (JP); Shohei Koide, Nagoya (JP); Jiro Yamamoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/115,227

(22) Filed: Dec. 8, 2020

(65) Prior Publication Data

US 2021/0086514 A1 Mar. 25, 2021

Related U.S. Application Data

(63) Continuation of application No. 16/823,018, filed on Mar. 18, 2020, now Pat. No. 10,882,317, which is a (Continued)

(30) Foreign Application Priority Data

Feb. 25, 2015 (JP) ..... 2015-034800

(51) Int. Cl.
*B41J 2/14* (2006.01)

(52) U.S. Cl.
CPC .. *B41J 2/14233* (2013.01); *B41J 2002/14491* (2013.01); *B41J 2202/18* (2013.01); *B41J 2202/20* (2013.01); *B41J 2202/21* (2013.01)

(58) Field of Classification Search
CPC ..... B41J 2/14233; B41J 2202/21; B41J 2202/18; B41J 2002/14491; B41J 2202/20
See application file for complete search history.

(56) References Cited

U.S. PATENT DOCUMENTS 6,796,640 B2 9/2004 Miyata
7,461,926 B2 12/2008 Sugahara
(Continued)

FOREIGN PATENT DOCUMENTS

EP 2889141 A1 7/2015
JP 2003-246065 A 9/2003
(Continued)

OTHER PUBLICATIONS

Nov. 1, 2016—U.S. Notice of Allowance—U.S. Appl. No. 15/053,035.
(Continued)

*Primary Examiner* — Geoffrey S Mruk
(74) *Attorney, Agent, or Firm* — Banner & Witcoff, Ltd.

(57) ABSTRACT

A liquid discharge apparatus is provided, including a liquid discharge head including: an upper substrate, a plurality of piezoelectric elements, an intermediate substrate, a lower substrate and a plurality of individual traces arranged on the upper substrate and extending toward the contacts arranged on the one end side in the second direction from the plurality of piezoelectric elements respectively.

10 Claims, 10 Drawing Sheets

Related U.S. Application Data continuation of application No. 16/053,935, filed on Aug. 3, 2018, now Pat. No. 10,639,891, which is a continuation of application No. 15/632,898, filed on Jun. 26, 2017, now Pat. No. 10,052,872, which is a continuation of application No. 15/053,105, filed on Feb. 25, 2016, now Pat. No. 9,701,118.

(56) References Cited

U.S. PATENT DOCUMENTS

| | | | |
|---|---|---|---|
| 9,144,980 | B2 | 9/2015 | Watanabe et al. |
| 9,254,652 | B2 | 2/2016 | Yazaki |
| 9,579,895 | B2 | 2/2017 | Yamashita et al. |
| 10,639,891 | B2 | 5/2020 | Naito et al. |
| 10,882,317 | B2 * | 1/2021 | Naito ..... B41J 2/14233 |
| 2003/0117464 | A1 | 6/2003 | Miyata |
| 2004/0041886 | A1 | 3/2004 | Suzuki |
| 2005/0068376 | A1 | 3/2005 | Sugahara |
| 2005/0270339 | A1 | 12/2005 | Sugahara |
| 2010/0128089 | A1 | 5/2010 | Sugahara |
| 2011/0122199 | A1 | 5/2011 | Takemoto et al. |
| 2012/0212531 | A1 | 8/2012 | Yamada et al. |
| 2013/0027467 | A1 | 1/2013 | Arthur et al. |
| 2013/0127956 | A1 | 5/2013 | Watanabe et al. |
| 2014/0184705 | A1 | 7/2014 | Wakamatsu et al. |
| 2014/0232787 | A1 | 8/2014 | Owaki |
| 2014/0253641 | A1 | 9/2014 | Furuya |
| 2014/0292949 | A1 | 10/2014 | Yazaki |
| 2014/0359984 | A1 | 12/2014 | Kashu et al. |
| 2014/0375722 | A1 | 12/2014 | Miyata |
| 2015/0042726 | A1 | 2/2015 | Enomoto et al. |
| 2015/0202875 | A1 | 7/2015 | Watanabe et al. |
| 2015/0352848 | A1 | 12/2015 | Watanabe et al. |
| 2016/0243829 | A1 | 8/2016 | Naito et al. |

FOREIGN PATENT DOCUMENTS

| | | | |
|---|---|---|---|
| JP | 2003-320669 | A | 11/2003 |
| JP | 2004-082669 | A | 3/2004 |
| JP | 2005-125743 | A | 5/2005 |
| JP | 2005-349568 | A | 12/2005 |
| JP | 2010-125597 | A | 6/2010 |
| JP | 2011-093137 | A | 5/2011 |
| JP | 2013-129191 | A | 7/2013 |
| JP | 2014-054835 | A | 3/2014 |
| JP | 2014-156065 | A | 8/2014 |
| JP | 2014-188717 | A | 10/2014 |
| JP | 2015-033838 | A | 2/2015 |
| JP | 2016-155305 | A | 9/2016 |

OTHER PUBLICATIONS

Feb. 25, 2016—Co-pending U.S. Appl. No. 15/053,035.
Jul. 31, 2018—(JP) Notice of Reasons for Rejection—App 2015-034800, Partial Eng Tran.
Mar. 24, 2020—(JP) Notice of Reasonse for Refusal—App 2019-041263, Eng Tran.
Feb. 2016 (unconfirmed on sale date)—Abstract/Information of HP ProX (Officejet Pro X551), also see US2013/0027467A1.

* cited by examiner

LIQUID DISCHARGE APPARATUS AND METHOD FOR MANUFACTURING THE SAME

CROSS REFERENCE TO RELATED APPLICATION

The present application is a continuation of prior U.S. application Ser. No. 16/823,018, filed on Mar. 18, 2020, which is a continuation of prior U.S. application Ser. No. 16/053,935, filed on Aug. 3, 2018, now U.S. Pat. No. 10,639,891 B2, issued May 5, 2020, which is a continuation of prior U.S. application Ser. No. 15/632,898, filed Jun. 26, 2017, now U.S. Pat. No. 10,052,872 B2, issued Aug. 21, 2018, is a continuation of prior U.S. application Ser. No. 15/053,105, filed Feb. 25, 2016, now U.S. Pat. No. 9,701,118 B2, issued Jul. 11, 2017, which claims priority from Japanese Patent Application No. 2015-034800 filed on Feb. 25, 2015, the disclosures of which are incorporated herein by reference in its entirety.

BACKGROUND

Field of the Invention

The present disclosure relates to a liquid discharge apparatus for discharging a liquid and method for manufacturing the liquid discharge apparatus.

Description of the Related Art

An ink-jet head for an ink-jet printer is known, which serves as a liquid discharge apparatus for discharging ink onto a recording medium while moving in the scanning direction. The ink-jet head is known, which includes, for example, a nozzle plate, a channel forming substrate, and a plurality of piezoelectric elements. The nozzle plate is formed with a plurality of nozzles. The channel forming substrate is composed of a substrate of silicon single crystal, and the channel forming substrate is joined to the nozzle plate. The channel forming substrate is formed with a plurality of pressure chambers which are communicated with the plurality of nozzles respectively and manifolds which supply the ink to the plurality of pressure chambers. The plurality of piezoelectric elements are arranged on the upper surface of the channel forming substrate while corresponding to the plurality of pressure chambers respectively.

In the case of the ink-jet head described above, the channel forming substrate is formed with not only the plurality of pressure chambers but also the manifolds each having a large volume (area). Therefore, the size of the channel forming substrate is increased. In this case, the channel forming substrate is produced such that the piezoelectric element is formed as a film on a silicon wafer, and then the wafer is cut and divided into those having a predetermined size. In this way, the film formation step for the piezoelectric elements exists, and hence the cost is expensive per one sheet of wafer to serve as the channel forming substrate. In order to decrease the cost by increasing the number of preparable channel forming substrates from one sheet of wafer, the size of the channel forming substrate can be decreased as small as possible.

SUMMARY

In relation to this point, an ink-jet head is known, in which a plurality of pressure chambers and manifolds are formed on different substrates. This ink-jet head includes a pressure chamber forming substrate (upper substrate) on which the plurality of pressure chambers are formed, a communication substrate (intermediate substrate) on which the manifolds and a plurality of communication channels are formed, a nozzle plate (lower substrate) on which a plurality of nozzles are formed, and a plurality of piezoelectric elements which are formed on the pressure chamber forming substrate.

Each of the pressure chamber forming substrate, the communication substrate, and the nozzle plate is formed of a silicon substrate. The plurality of nozzles, which are formed on the nozzle plate, are arranged in two arrays. The plurality of pressure chambers, which are formed on the pressure chamber forming substrate, are also arranged in two arrays in accordance with the arrangement of the nozzles. The communication substrate is arranged between the pressure chamber forming substrate and the nozzle plate, and the communication substrate protrudes to the both sides as compared with the pressure chamber forming substrate in the direction orthogonal to the arrangement direction of the pressure chambers. The two manifolds, which correspond to the two pressure chamber arrays, are formed at the two protruding portions disposed on the both sides, and a plurality of communication channels are formed between the two manifolds. The nozzle plate is joined to the area of the communication substrate on which the plurality of communication channels are formed. The plurality of communication channels of the communication substrate are communicated with the plurality of nozzles of the nozzle plate respectively.

The plurality of piezoelectric elements are arranged in two arrays in accordance with the arrangement of the pressure chambers on the upper surface of the pressure chamber forming substrate. Traces are connected to the respective piezoelectric elements, and the traces are led out to the inner side of the two arrays of the piezoelectric element arrays. Further, a trace member is joined to the area of the pressure chamber forming substrate disposed between the two arrays of the piezoelectric element arrays. The trace member is electrically connected to the traces led out from the piezoelectric elements.

In the case of the structure as described above, the plurality of pressure chambers and the manifolds are formed on the different substrates. In other words, the manifold is not formed on the pressure chamber forming substrate. Therefore, it is possible to miniaturize the pressure chamber forming substrate on which the piezoelectric elements are formed as the film.

In the case of the ink-jet head in which the plurality of pressure chambers and the manifolds are formed on the different substrates as described above, it is possible to decrease the cost by miniaturizing the pressure chamber forming substrate (upper substrate) as compared with the ink-jet head in which the channel forming substrate is formed with not only the plurality of pressure chambers but also the manifolds each having a large volume (area). However, the present inventors have found out that there is a scope to further decrease the cost.

The nozzle plate (lower substrate) of the ink-jet head in which the plurality of pressure chambers and the manifolds are formed on the different substrates is composed of a silicon substrate, and the nozzles are formed through the silicon substrate by means of the dry etching. More specifically, in order to form the nozzle, the nozzle is formed by applying the deep etching processing such as the Bosch process processing or the like. On account of the execution of the processing as described above, the production cost is expensive per one sheet of wafer to serve as the nozzle plate. Further, it is necessary to perform the polishing step in order to thin the nozzle plate, and hence the production cost per one sheet of wafer is increased as well. Therefore, in order that a large number of nozzle plates can be cut out from one sheet of wafer as much as possible, the size of one sheet of nozzle plate can be also decreased as much as possible.

However, in the case of the ink-jet head in which the plurality of pressure chambers and the manifolds are formed on the different substrates, the trace, which is connected to each of the piezoelectric elements, is led out to the area disposed between the two piezoelectric element arrays of the pressure chamber forming substrate, and the trace member is joined to the area. In relation thereto, it is necessary that the distance between the two piezoelectric element arrays, i.e., the distance between the two pressure chamber arrays should be increased to be not less than a certain distance. In accordance therewith, the distance between the two nozzle arrays of the nozzle plate is also increased. Accordingly, the size of the nozzle plate is consequently increased.

An object of the present teaching is to miniaturize a lower substrate as well on which nozzles are formed, in addition to miniaturization of an upper substrate on which piezoelectric elements are arranged.

According to a first aspect of the present teaching, there is provided a liquid discharge apparatus configured to discharge a liquid onto a medium including:

a liquid discharge head including:

an upper substrate including a plurality of first pressure chambers disposed in a first direction, a plurality of second pressure chambers disposed in the first direction and arranged at positions deviated in a second direction orthogonal to the first direction, and a plurality of contacts arranged on one end side in the second direction;

a plurality of piezoelectric elements arranged at positions of the upper substrate corresponding to the plurality of first pressure chambers and the plurality of second pressure chambers;

an intermediate substrate including a first manifold communicated with the first pressure chambers and a second manifold communicated with the second pressure chambers, a length of the intermediate substrate in the second direction being larger than that of the upper substrate;

a lower substrate including a plurality of first nozzles communicated with the first pressure chambers and a plurality of second nozzles communicated with the second pressure chambers, a length of the lower substrate in the second direction being smaller than that of the intermediate substrate; and a plurality of individual traces arranged on the upper substrate and extending toward the contacts arranged on the one end side in the second direction from the plurality of piezoelectric elements respectively.

According to a second aspect of the present teaching, there is provided a method for manufacturing a liquid discharge apparatus including:

preparing an upper substrate;

forming, in the upper substrate, a plurality of first pressure chambers disposed in a first direction, a plurality of second pressure chambers disposed in the first direction and arranged at positions deviated in a second direction orthogonal to the first direction, and a plurality of contacts arranged on one end side in the second direction;

forming, on the upper substrate, a plurality of piezoelectric elements at positions corresponding to the plurality of first pressure chambers and the plurality of second pressure chambers;

preparing an intermediate substrate of which length in the second direction is larger than that of the upper substrate;

forming, in the intermediate substrate, a first manifold communicated with the first pressure chambers and a second manifold communicated with the second pressure chambers;

preparing a lower substrate of which length in the second direction is smaller than that of the intermediate substrate;

forming, in the lower substrate, a plurality of first nozzles communicated with the first pressure chambers and a plurality of second nozzles communicated with the second pressure chambers; and forming a plurality of individual traces arranged on the upper substrate and extending toward the contacts arranged on the one end side in the second direction from the plurality of piezoelectric elements respectively.

In the present teaching, the substrate (upper substrate), on which the first pressure chambers and the second pressure chambers aligned in the second direction are formed, is distinct from the substrate (intermediate substrate) on which the manifolds communicated with the pressure chambers are formed. In other words, the size of the upper substrate can be decreased by an amount corresponding to the manifold not formed on the upper substrate. Further, in the present teaching, both of the individual traces led out from the piezoelectric elements corresponding to the first pressure chambers and the individual traces led out from the piezoelectric elements corresponding to the second pressure chambers are led out toward the contacts arranged on the one side in the second direction with respect to the plurality of piezoelectric elements. In other words, the contacts (connecting portions with respect to the trace members) are not arranged between the first pressure chambers and the second pressure chambers. Therefore, it is possible to allow the first pressure chambers and the second pressure chambers to approach to one another, and it is possible to decrease the distance in the second direction between the nozzles communicated with the first pressure chambers and the nozzles communicated with the second pressure chambers. Accordingly, it is also possible to decrease the width of the lower substrate in the second direction.

BRIEF DESCRIPTION OF THE DRAWINGS

In FIG. 6B, the nozzles 30 and the pressure chambers 51 are omitted.

DESCRIPTION OF THE EMBODIMENTS

Figure 1:
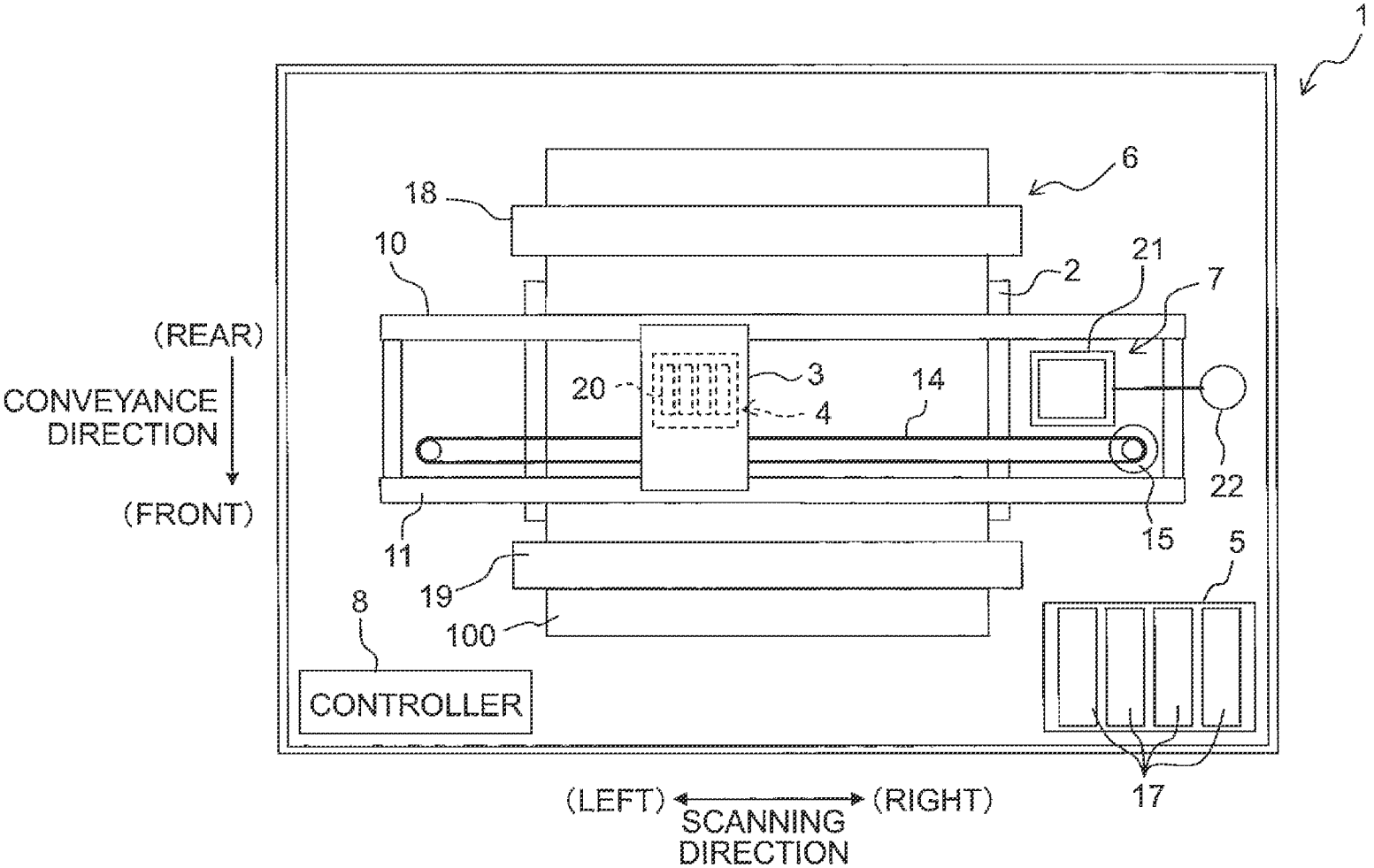
FIG. 1 depicts a schematic top view illustrating a printer according to an embodiment of the present invention.

Next, an embodiment of the present teaching will be explained. An explanation will be made with reference to FIG. 1 about a schematic arrangement of the ink-jet printer 1. Note that the respective front-rear, left, and right directions depicted in FIG. 1 are defined as "front", "rear", "left", and "right" of the printer. Further, the front side of the paper surface is defined as "upward", and the rear side of the paper surface is defined as "downward".

<Schematic Arrangement of Printer>

As depicted in FIG. 1, the ink-jet printer 1 includes, for example, a platen 2, a carriage 3, an ink-jet head 4, a cartridge holder 5, a conveyance mechanism 6, a maintenance device, and a controller 8.

Recording paper 100 as a recording medium is placed on the upper surface of the platen 2. The carriage 3 is constructed so that the carriage 3 is reciprocatively movable in the left-right direction (hereinafter referred to as "scanning direction" as well) along two guide rails 10, 11 in an area opposed to the platen 2. An endless belt 14 is connected to the carriage 3. The endless belt 14 is driven by a carriage driving motor 15, and thus the carriage 3 is moved in the scanning direction.

Figure 2:
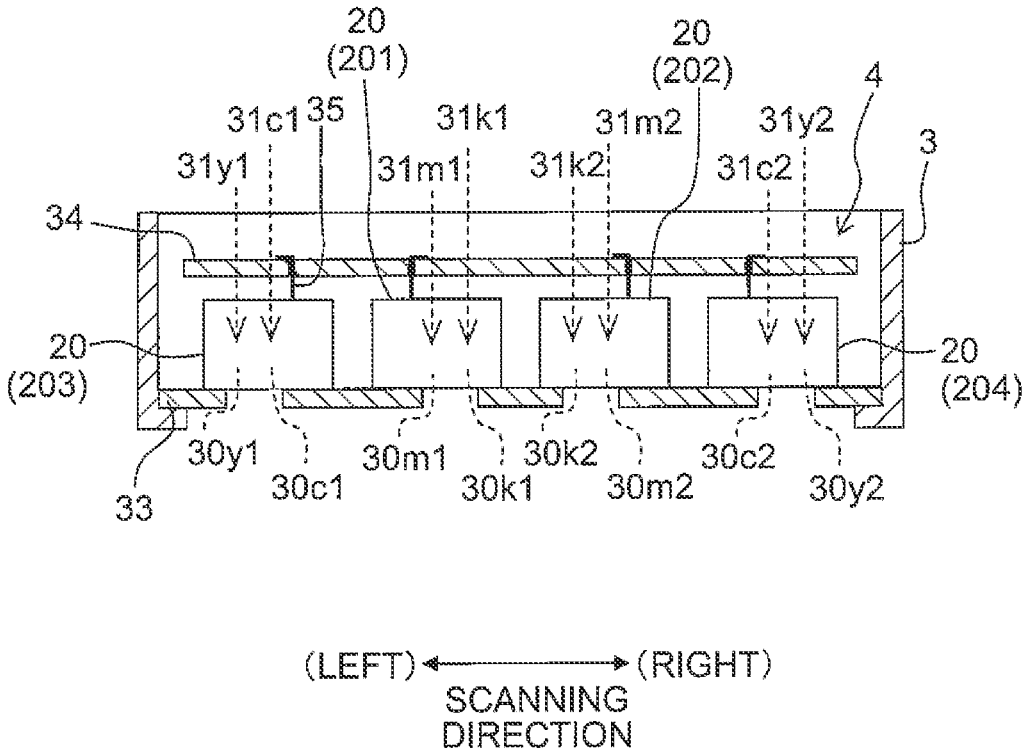
FIG. 2 depicts a sectional view illustrating a carriage to which four discharge heads of an ink-jet head are attached.

FIG. 2 depicts a sectional view illustrating the carriage 3 to which four discharge heads 20 of the ink-jet head 4 are attached. The ink-jet head 4 is attached to the carriage 3, and the ink-jet head 4 is movable in the scanning direction together with the carriage 3. As depicted in FIG. 2, the ink-jet head 4 is provided with the four discharge heads 20, which are aligned in the scanning direction. The ink-jet head 4 is connected by unillustrated tubes respectively to the cartridge holder 5 (see FIG. 1) to which ink cartridges 17 of four colors (black, yellow, cyan, and magenta) are installed. Each of the discharge heads 20 has a plurality of nozzles 30, which are formed on the lower surface thereof. The nozzles 30 of each of the discharge heads 20 discharge the inks supplied from the ink cartridges 17 toward the recording paper 100 placed on the platen 2. Details of the discharge head 20 of the ink-jet head 4 will be described later on.

The conveyance mechanism 6 has two conveyance rollers 18, 19 which are arranged so that the platen 2 is interposed therebetween in the front-rear direction. The conveyance mechanism 6 conveys the recording paper 100 placed on the platen 2 in the frontward direction (hereinafter referred to as "conveyance direction" as well) by means of the two conveyance rollers 18, 19.

Figure 3:
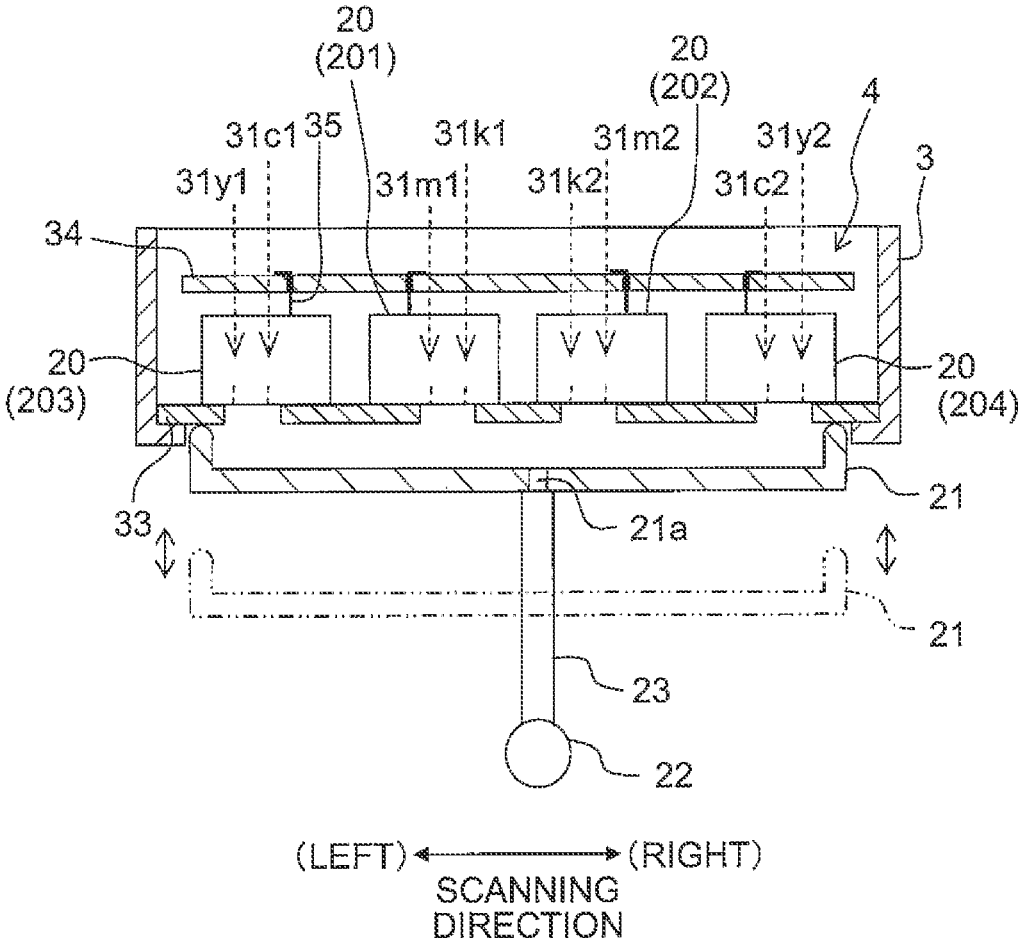
FIG. 3 depicts a sectional view illustrating the carriage as provided when a cap is disposed at a cap position.

The maintenance device 7 is provided to perform the suction purge in order to maintain and recover the discharge performance of the ink-jet head 4. The maintenance device 7 is arranged at the position disposed on the right side as compared with the platen 2 in the range of movement of the carriage 3 in the scanning direction. As depicted in FIGS. 1 and 3, the maintenance device 7 includes a cap 21 and a suction pump 22. FIG. 3 depicts a sectional view illustrating the carriage 3 as provided when the cap 21 is disposed at the cap position. The cap 21 is driven in the upward-downward direction by an unillustrated cap driving motor. Accordingly, the cap 21 is movable to the cap position (position indicated by solid lines in FIG. 3) to cover the nozzles 30 of the four discharge heads 20 of the ink-jet head 4 and the uncap position (position indicated by alternate long and two short dashes lines depicted in FIG. 3) separated from the ink-jet head 4. The suction pump 22 is connected to a discharge port 21*a* of the cap 21 by a tube 23.

The operation of the maintenance device 7 during the suction purge is as follows. When the carriage 3 is disposed at the position opposed to the cap 21 on the right side of the platen 2, the cap 21 is driven upwardly by the cap driving motor. Accordingly, the cap 21 is moved upwardly to the cap position to cover the nozzles 30 of the four discharge heads 20. When the space in the cap 21 is subjected to the pressure reduction by the suction pump 22 in this state, the ink is forcibly discharged from the respective nozzles 30. In this situation, the dust, bubbles, and/or viscosity-increased ink, which exists in the ink channels in the discharge heads 20, is discharged together.

The controller 8 includes, for example, ROM (Read Only Memory), RAM (Random Access Memory), and ASIC (Application Specific Integrated Circuit) including various control circuits. The controller 8 executes various processes including, for example, the printing on the recording paper 100 and the maintenance of the ink-jet head 4 by using ASIC in accordance with programs stored in ROM.

For example, in the printing process, the controller 8 controls, for example, the ink-jet head 4 and the carriage driving motor 15 on the basis of the printing instruction input from an external device such as PC or the like so that an image or the like is printed on the recording paper 100. Specifically, the ink discharge operation in which the ink is discharged while moving the ink-jet head 4 in the scanning direction together with the carriage 3 and the conveyance operation in which the recording paper 100 is conveyed by a predetermined amount in the conveyance direction by means of the conveyance rollers 18, 19 are alternately performed. Further, in the maintenance process, the controller 8 controls the suction pump 22 and the cap driving motor for driving the cap 21 upwardly and downwardly to perform the suction purge described above.

<Details of Ink-Jet Head>

Next, an explanation will be made about the detailed structure of the ink-jet head 4. As depicted in FIG. 2, a plate-shaped unit holder 33 is provided at the lower portion of the carriage 3. The four discharge heads 20 are attached to the upper surface of the unit holder 33 while being aligned in the scanning direction. Further, the carriage 3 is provided with a circuit board 34, which is arranged to extend over the four discharge heads 20 over or above the four discharge heads 20. Further, the circuit board 34 and the four discharge heads 20 are connected by COF 35 (Chip On Film) as a trace member respectively. The circuit board 34 is electrically connected to the controller 8 of the printer 1 (see FIG. 1). The instruction from the controller 8 is received, and various control signals are output to the respective discharge heads 20.

Figure 4:
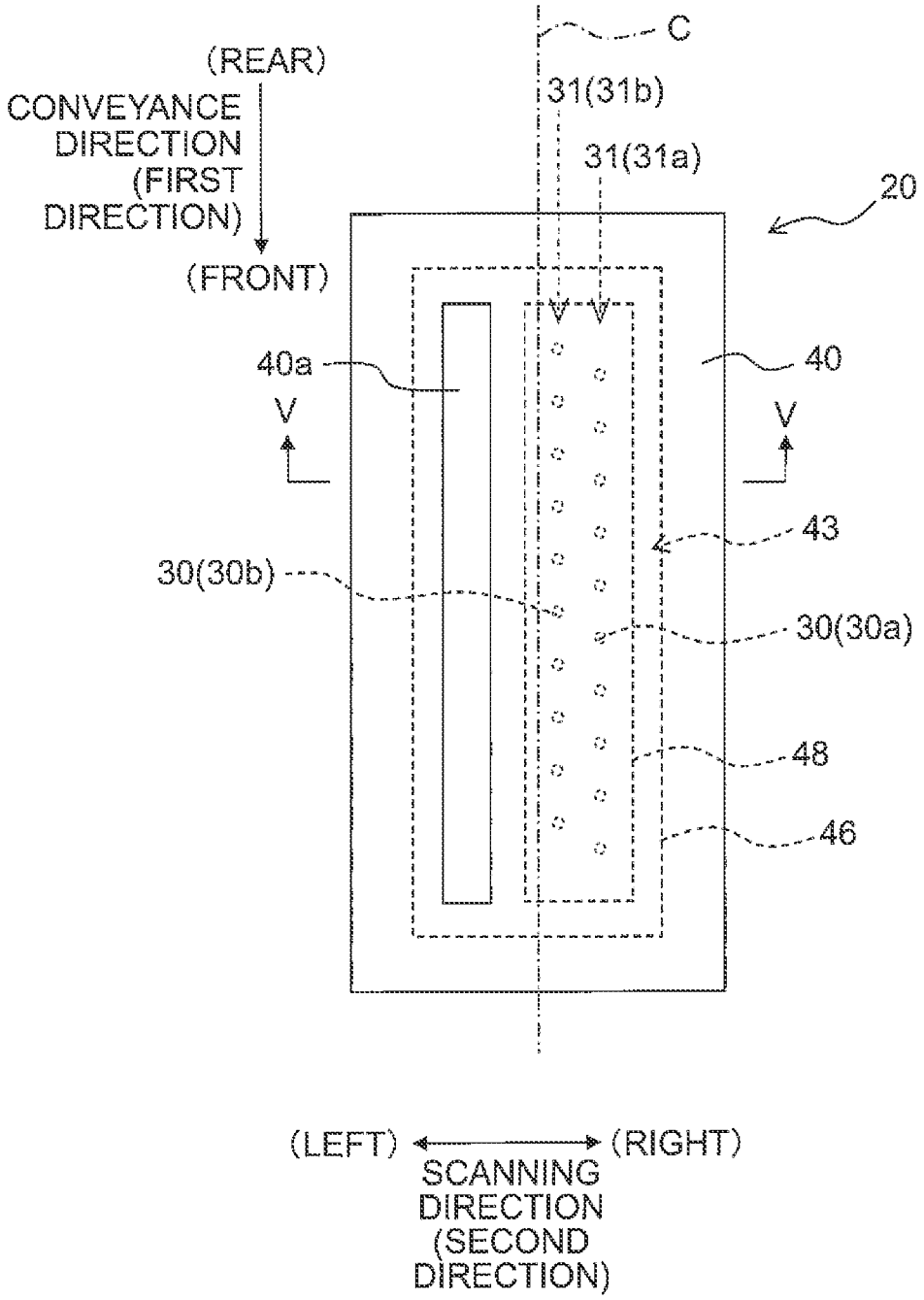
FIG. 4 depicts a top view illustrating one discharge head of the ink-jet head.

The plurality of nozzles 30 are formed on the lower surface of each of the discharge heads 20. The plurality of nozzles 30 of each of the discharge heads 20 are exposed from openings formed for the unit holder 33. As depicted in FIG. 4, the plurality of nozzles 30 are arranged in the conveyance direction to construct two nozzle arrays 31 (31*a*, 31*b*). Note that the positions of the nozzles 30 are deviated in the conveyance direction between the two nozzle arrays 31*a*, 31*b*, and the plurality of nozzles 30 are arranged in a so-called zigzag form.

The two nozzle arrays 31 of one discharge head 20 discharge the inks of different colors respectively. Note that in the following explanation, as for those of the constitutive elements of the printer 1 corresponding to the ink of black (K), yellow (Y), cyan (C), and magenta (M) respectively, any one of signs of "k" to indicate black, "y" to indicated yellow, "c" to indicate cyan, and "m" to indicate magenta is appropriately affixed after the symbol to indicate the constitutive element so as to understand to which ink the symbol corresponds. For example, the nozzle array 31*k* depicted in FIG. 2 indicates the nozzle array 31 for discharging the black ink.

The four types of nozzle arrays 31, which discharge the ink of four colors respectively, are arranged in bilateral symmetry (left-right symmetry) in relation to the four discharge heads 20 as a whole. Specifically, the discharge head 201 and the discharge head 202, which are included in the four discharge heads 20 and which are arranged on the inner side in the scanning direction respectively, have the nozzle arrays 31*k* for the black positioned on the inner side and the nozzle arrays 31*m* for the magenta arranged on the outer side. Further, the discharge head 203 arranged on the left side of the discharge head 201 and the discharge head 204 arranged on the right side of the discharge head 202, i.e., the two discharge heads 203, 204 disposed on the outer side respectively have the nozzle arrays 31*c* for the cyan positioned on the inner side and the nozzle arrays 31*y* for the yellow positioned on the outer side.

In other words, the two nozzle arrays 31 for one color ink, i.e. the eight nozzle arrays 31 in total exist in the entire ink-jet head 4 having the four discharge heads 20. Then, the eight nozzle arrays 31 are arranged in an order of the nozzle arrays 31*k* for the black, the nozzle arrays 31*m* for the magenta, the nozzle arrays 31*c* for the cyan, and the nozzle arrays 31*y* for the yellow as referred to from the inner side toward the both left and right sides. Note that in FIG. 2, as for the nozzles 30 and the nozzle arrays 31 for the respective colors, those arranged on the left side are affixed with the symbol "1", and those arranged on the right side are affixed with the symbol "2". For example, the nozzle 30*c*1 is the nozzle 30 which is arranged on the left side and which discharges the cyan ink.

That is, the nozzle arrays 31 for the four colors are arranged in left-right symmetry in an order of black, magenta, cyan, and yellow as referred to from the central side. In the case of the structure as described above, it is possible to obtain the same landing sequence of the four colors of ink onto the recording paper 100 between when the carriage 3 is moved leftward and when the carriage 3 is moved rightward. Accordingly, it is possible to suppress the difference in the color to be small in the bidirectional printing between the image portion that is formed when the carriage 3 is moved leftward and the image portion that is formed when the carriage 3 is moved rightward.

<Structure of Discharge Head>

Next, an explanation will be made about the specified structure of the discharge head 20. Note that the four discharge heads 20 of the ink-jet head 4 have the same structure. Therefore, one of the four discharge heads 20 will be explained. Note that in FIG. 6, a protective member 42 depicted in FIGS. 5 and 7 is schematically depicted by alternate long and two short dashes lines.

Figure 5:
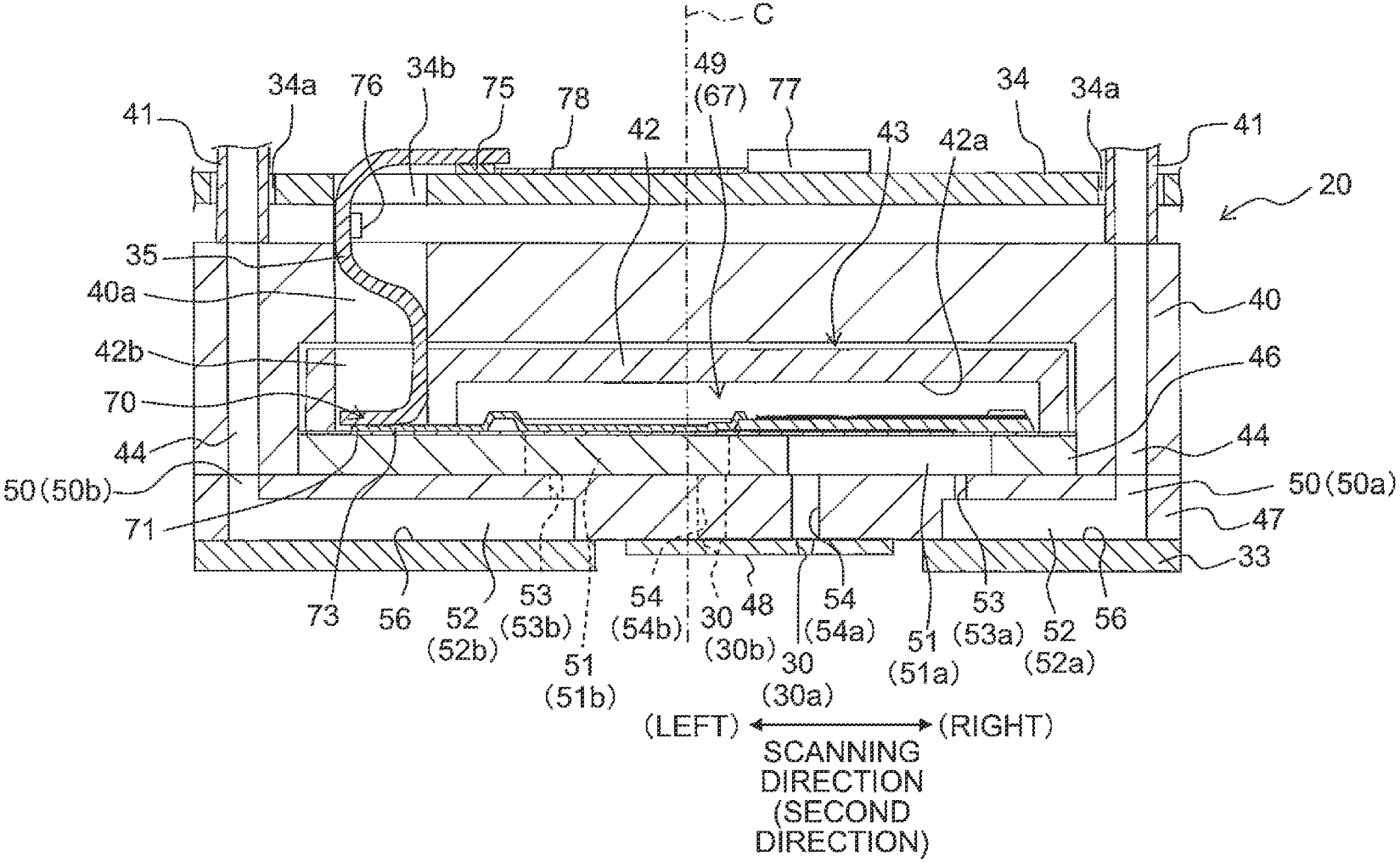
FIG. 5 depicts a sectional view taken along a line V-V depicted in FIG. 4.

As depicted in FIGS. 4 and 5, the discharge head 20 has a holder member 40 and a main head body 43, which is retained by the holder member 40. The holder member 40 is formed of, for example, synthetic resin or metal. Two ink supply channels 44 are formed respectively at two portions of the holder member 40 to interpose the main head body 43 in the scanning direction (left-right direction).

Through-holes 34*a* are formed through the circuit board 34 arranged over or above the discharge head 20. Cylindrical channel members 41, which are provided to supply the inks to the discharge head 20, penetrate through the circuit board 34 at the through-holes 34*a*. The ink supply channels 44 of the holder member 40 are connected to the cartridge holder 5 (see FIG. 1) via the channel members 41 described above. Then, the ink of the ink cartridges 17 of two colors (black and magenta or cyan and yellow) installed to the cartridge holder 5 are supplied respectively to the main head body 43 via the ink supply channels 44. Further, a through-hole 34*b*, which is provided to allow COF 35 connected to the piezoelectric actuator 49 of the main head body 43 to pass therethrough, is also formed through the circuit board 34.

The main head body 43 has an upper substrate 46, an intermediate substrate 47, a lower substrate 48, and a piezoelectric actuator 49. Channel holes, which are provided as parts of the ink channels, are formed through the upper substrate 46, the intermediate substrate 47, and the lower substrate 48 respectively. Note that each of the upper substrate 46, the intermediate substrate 47, and the lower substrate 48 is composed of a silicon single crystal substrate.

Figure 6A:
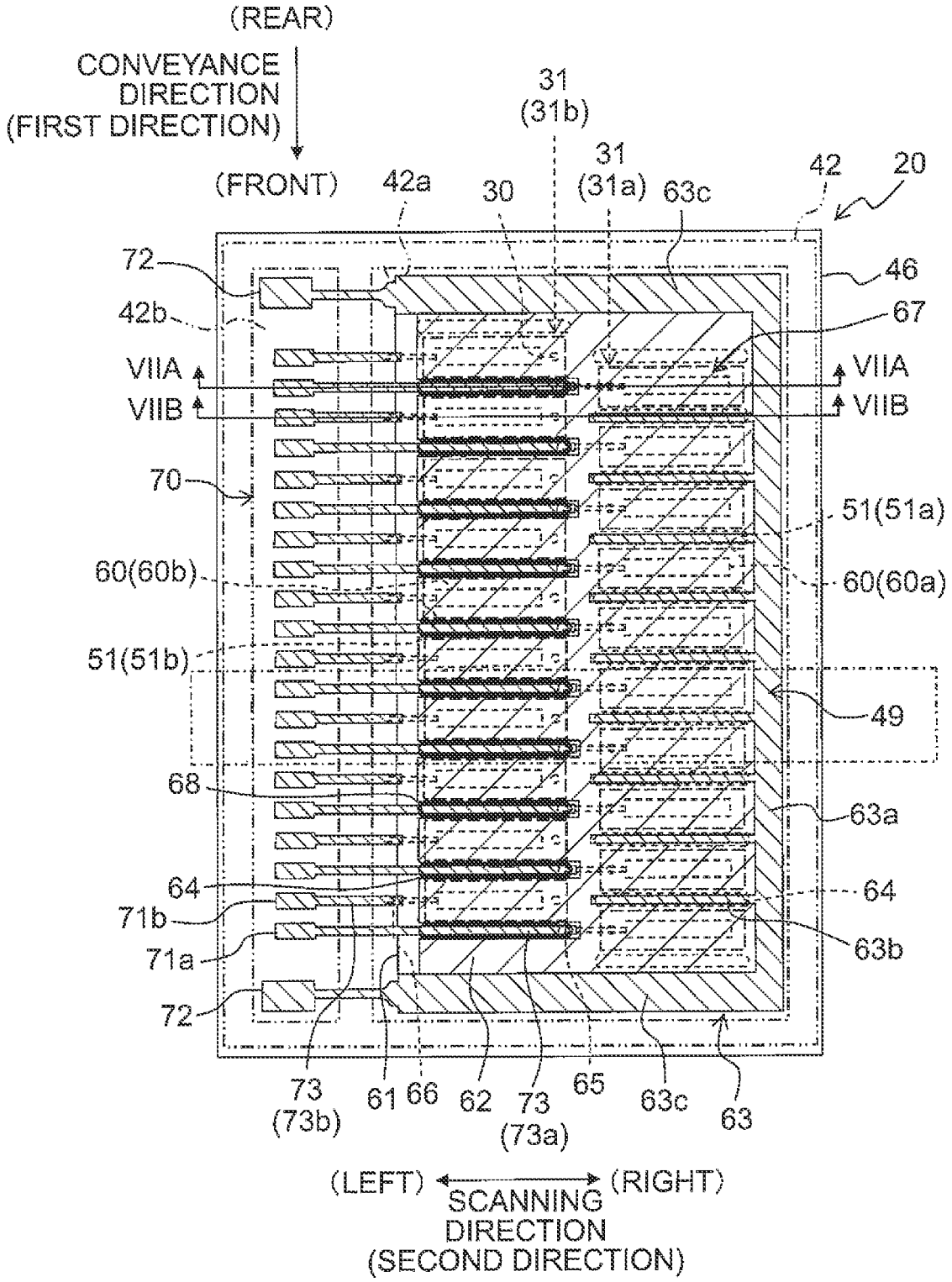
FIG. 6A depicts a top view illustrating the discharge head (upper substrate) and FIG. 6B depicts an enlarged view of a region enclosed by the one-dot chain line depicted in FIG. 6A.
Figure 6B:
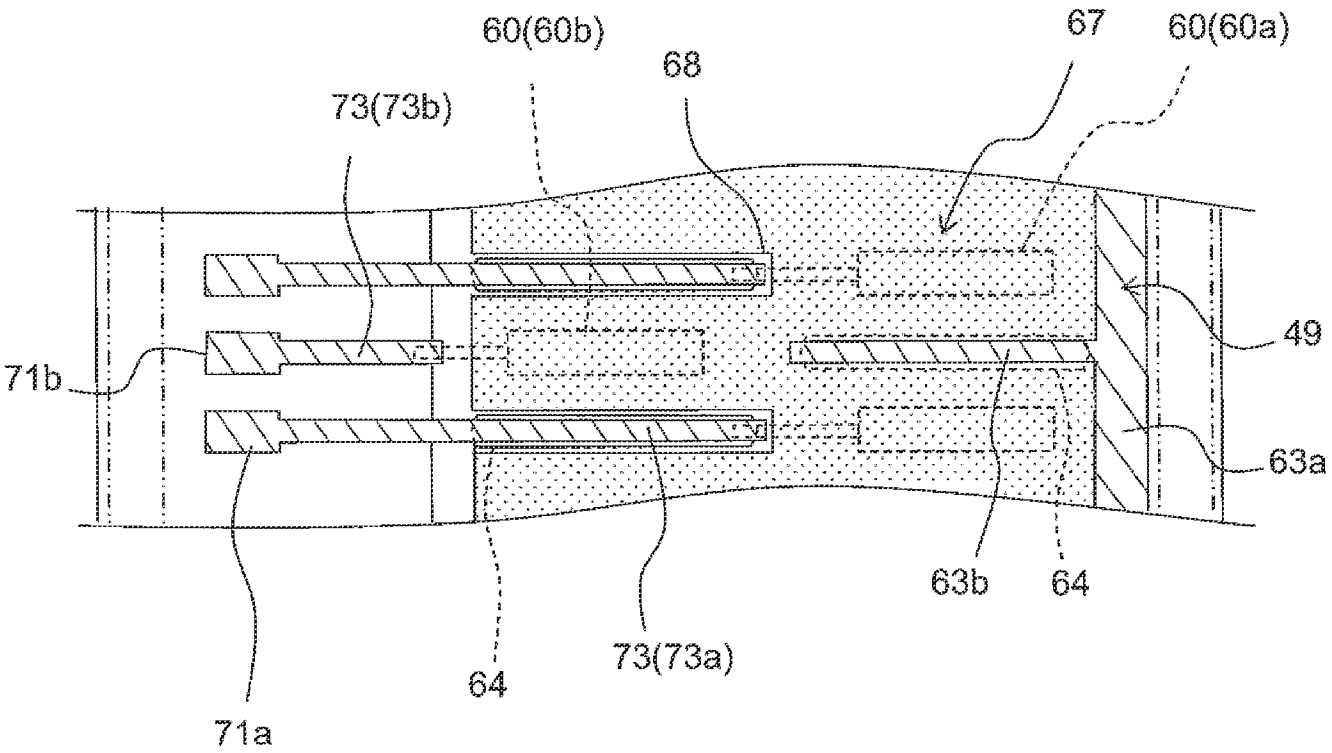

As depicted in FIGS. 5 to 7, the plurality of pressure chambers 51 are formed for the upper substrate 46. The plurality of pressure chambers 51 include a plurality of first pressure chambers 51*a* that are arranged in the conveyance direction and a plurality of second pressure chambers 51*b* that are arranged in the conveyance direction at the positions deviated to the left side as compared with the plurality of first pressure chambers 51*a*. Each of the pressure chambers 51 has a rectangular planar shape, which is long in the scanning direction.

The upper substrate 46 has a vibration film 57 which covers the plurality of pressure chambers 51 (first pressure chambers 51*a*, second pressure chambers 51*b*). The vibration film 57 is a film composed of silicon dioxide ($SiO_2$) or silicon nitride ($SiN_X$) formed by oxidizing or nitriding a part of the upper substrate 46 of silicon. An electric connecting portion 70, which is arranged with contacts 71*a*, 71*b*, 72 of the piezoelectric actuator 49 described later on, is provided on the upper surface of the left end portion of the upper substrate 46. COF 35 is joined to the electric connecting portion 70.

The intermediate substrate 47 is joined to the lower surface of the upper substrate 46. Two ink supply holes 50*a*, 50*b*, which are communicated with the two ink supply channels 44 respectively, are formed on the upper surface of the intermediate substrate 47. Note that in the following explanation, if it is unnecessary to particularly distinguish the ink supply holes 50*a*, 50*b* from each other, they are simply referred to as "ink supply holes 50" in some cases. In the same manner as described above, in relation to the other constitutive elements, they are also referred to while omitting the suffixes a, b or the like in some cases. Further, two left and right manifolds 52*a*, 52*b*, which are communicated with the two ink supply holes 50 respectively, are formed for the intermediate substrate 47. The right first manifold 52*a* is overlapped with the outer end portions (right end portions) of the plurality of first pressure chambers 51*a* in the scanning direction, and the right first manifold 52*a* extends in the conveyance direction (direction perpendicular to the paper surface of FIG. 5). The left second manifold 52*b* is overlapped with the outer end portions (left end portions) of the plurality of second pressure chambers 51*b* in the scanning direction, and the left second manifold 52*b* extends in the conveyance direction. Note that the manifolds 52*a*, 52*b* of the intermediate substrate 47 are arranged so that the manifolds 52*a*, 52*b* protrude to the left and right as compared with the pressure chambers 51*a*, 51*b*. On this account, the width of the intermediate substrate 47 in the scanning direction is larger than the width of the upper substrate 46 in the scanning direction. Then, the first ink supply hole 50*a* communicated with the first manifold 52*a* and the second ink supply hole 50*b* communicated with the second manifold 52*b* are formed in the areas of the upper surface of the intermediate substrate 47 disposed on the outer side in the scanning direction as compared with the upper substrate 46.

The lower side of each of the manifolds 52 is covered with a film 56 made of synthetic resin. The unit holder 33, which retains the discharge head 20, is arranged on the lower side of the film 56. A plurality of first communication holes 53*a* for making communication between the first manifold 52*a* and the outer end portions (right end portions) of the plurality of first pressure chambers 51*a* and a plurality of second communication holes 53*b* for making communication between the second manifold 52*b* and the outer end portions (left end portions) of the plurality of second pressure chambers 51*b* are formed through the intermediate substrate 47. Further, a plurality of first through-holes 54*a* for making communication with the inner end portions (left end portions) of the plurality of first pressure chambers 51*a* and a plurality of second through-holes 54*b* for making communication with the inner end portions (right end portions) of the plurality of second pressure chambers 51*b* are formed through the intermediate substrate 47.

The lower substrate 48 is joined to the lower surface of the intermediate substrate 47. The lower substrate 48 is formed with the plurality of first nozzles 30*a* communicated with the plurality of first through-holes 54*a* of the intermediate substrate 47 respectively and the plurality of second nozzles 30*b* communicated with the plurality of second through-holes 5*b* respectively. As depicted in FIG. 4, the first nozzle array 31*a* is constructed by the plurality of first nozzles 30*a*, and the second nozzle array 31*b*, which is aligned with the first nozzle array 31*a* in the scanning direction, is constructed by the plurality of second nozzles 30*b*. Note that as depicted in FIG. 5, the lower substrate 48 is not joined to the entire region of the lower surface of the intermediate substrate 47, but the lower substrate 48 is joined to only a partial area of the intermediate substrate 47 in which the plurality of communication holes 54 are formed between the two manifolds 52. In other words, the lower substrate 48 is not overlapped with the two manifolds 52. Further, the lower substrate 48 is not overlapped with the electric connecting portion 70 of the upper substrate 46 at which the plurality of contacts 71, 72 are arranged, in the upward-downward direction as the stacking direction of the substrates 46 to 48. Accordingly, the width of the lower substrate 48 in the scanning direction is smaller than the width of the upper substrate 46 and the width of the intermediate substrate 47.

Note that the two nozzle arrays 31*a*, 31*b*, which are formed on the lower substrate 48, are arranged while being deviated toward the side opposite to the electric connecting portion 70 with respect to the center line C of the discharge head 20 in the scanning direction. The reason, why the nozzle arrays 31 are arranged while being deviated in the scanning direction as described above, will be described later on. Further, as depicted in FIG. 2, the two nozzle arrays 31 are arranged while being deviated to the inner side in relation to the two discharge heads 201, 202 disposed on the inner side, of the four discharge heads 20. On the other hand, the two nozzle arrays 31 are arranged while being deviated to the outer side in relation to the two discharge heads 203, 204 disposed on the outer side.

The piezoelectric actuator 49 applies the discharge energy to the ink contained in the plurality of pressure chambers 51 in order that the ink is discharged from the nozzles 30 respectively. As depicted in FIGS. 5 to 7, the piezoelectric actuator 49 is arranged on the upper surface of the vibration film 57 of the upper substrate 46. The piezoelectric actuator 49 has a plurality of piezoelectric elements 67 corresponding to the plurality of pressure chambers 51.

At first, the structure of the piezoelectric element 67 will be explained. A plurality of individual electrodes 60 are arranged on the upper surface of the vibration film 57 of the upper substrate 46 while being opposed to the plurality of pressure chambers 51 respectively. That is, the plurality of first individual electrodes 60*a* are arranged in the conveyance direction while corresponding to the plurality of first pressure chambers 51*a* respectively. The plurality of second individual electrodes 60*b* are arranged in the conveyance direction while corresponding to the plurality of second pressure chambers 51*b* respectively. Each of the individual electrodes 60 is formed of platinum (Pt). Each of the individual electrodes 60 has a rectangular shape that is smaller than the pressure chamber 51 as viewed in a plane view.

Figure 7A:
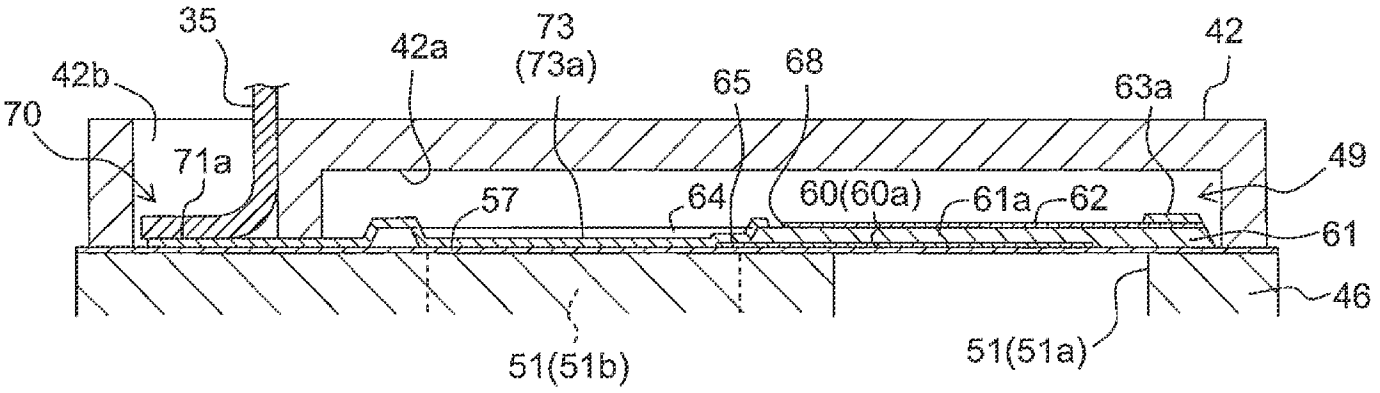
FIG. 7A depicts a sectional view taken along a line VIIA-VIIA depicted in FIG. 6.
Figure 7B:
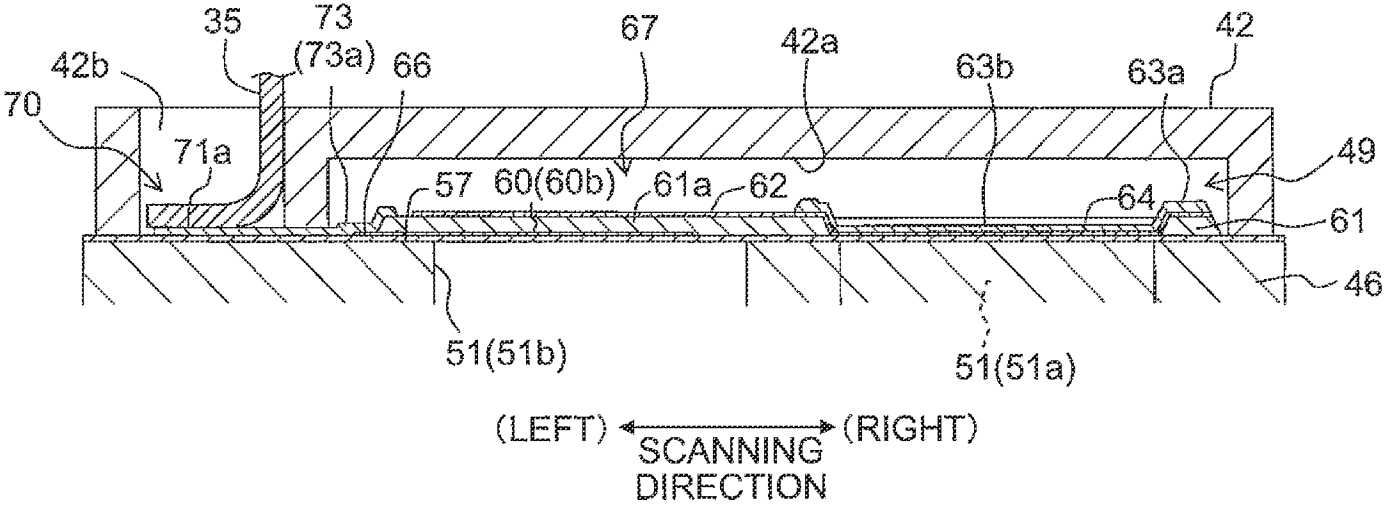
FIG. 7B depicts a sectional view taken along a line VIIB-VIIB depicted in FIG. 6.

As depicted in FIGS. 6 and 7, the piezoelectric film 61, which is composed of a piezoelectric material such as PZT (lead titanate zirconate) or the like, is formed on the upper surface of the vibration film 57. The piezoelectric film 61 is formed, for example, by means of the sol-gel method. The piezoelectric film 61 commonly covers both of the plurality of first individual electrodes 60*a* disposed on the right side and the plurality of second individual electrodes 60*b* disposed on the left side. As depicted in FIGS. 6 and 7B, a slit 64, which extends in the scanning direction, is formed at a portion of the right side portion of the piezoelectric film 61 disposed between the two first individual electrodes 60*a* which adjoin in the conveyance direction. Further, as depicted in FIGS. 6 and 7A, a slit 64, which extends in the scanning direction, is also formed at a portion of the left side portion of the piezoelectric film 61 disposed between the two second individual electrodes 60*b* which adjoin in the conveyance direction. In other words, the two slits 64 of the piezoelectric film 61 are arranged respectively on the both sides in the conveyance direction of each of the individual electrodes 60. The slit 64 is formed for the piezoelectric film 61 between the two individual electrodes 60, which adjoin in the conveyance direction. Therefore, it is easy to greatly deform the portion of the piezoelectric film 61 opposed to each of the pressure chambers 51.

The left end portion of the first individual electrode 60*a* further extends leftward beyond the left end of the first pressure chamber 51*a*, and the left end portion of the first individual electrode 60*a* is arranged at the position overlapped with the right end portion of the slit 64 of the piezoelectric film 61. In the slit 64, the left end portion of the first individual electrode 60*a* is exposed from the piezoelectric film 61 to constitute a first exposed portion 65. The left end portion of the second individual electrode 60*b* further extends leftward beyond the left end of the second pressure chamber 51*b*, and the left end portion of the second individual electrode 60*b* is exposed from the edge on the left side of the piezoelectric film 61 to constitute a second exposed portion 66.

The common electrode 62 is arranged so that the piezoelectric film 61 is covered therewith. The common electrode 62 is formed of, for example, iridium (Ir). Further, the common electrode 62 is opposed to the plurality of individual electrodes 60 (first individual electrodes 60*a*, second individual electrodes 60*b*) with the piezoelectric film 61 intervening therebetween. Each of cutouts 68, which is cut out from the left side, is formed between portions of the left side portion of the common electrode 62 opposed to the two second individual electrodes 60*b*, which adjoin in the conveyance direction. Accordingly, the left side portion of the common electrode 62 is formed to have a comb-shaped form extending leftward from the central portion of the common electrode 62. In other words, the common electrode 62 is not arranged between the two second individual electrodes 60*b*, which adjoin in the conveyance direction.

Then, one piezoelectric element 67 is constructed for one pressure chamber 51 by the respective portions of the common electrode 32, the piezoelectric film 61, and the individual electrode 60 corresponding thereto. Further, the plurality of piezoelectric elements 67, which correspond to the plurality of pressure chambers 51 respectively, are arranged in two arrays in accordance with the arrangement of the pressure chambers 51. Note that in relation to each of the piezoelectric elements 67, the portion of the piezoelectric film 61 (hereinafter referred to as "active portion 61*a*" as well), which is interposed between the individual electrode 60 and the common electrode 62, is polarized upwardly in the thickness direction, i.e., in the direction directed from the individual electrode 60 disposed on the lower side to the common electrode 62 disposed on the upper side.

An auxiliary conductor 63, which is arranged while being brought in contact with the common electrode 62, is provided on the common electrode 62. The auxiliary conductor 63 constructs distinct current routes among the different portions of the common electrode 62. Accordingly, any dispersion of the electric potential can be suppressed in the common electrode 62. The auxiliary conductor 63 is formed of a metal material having a small electric resistivity including, for example, gold (Au) and aluminum (Al). Further, the thickness of the auxiliary conductor 63 is larger than the thickness of the common electrode 62. The auxiliary conductor 63 has a first conductive portion 63*a*, a plurality of second conductive portions 63*b*, which are in conduction with the first conductive portion 63*a*, and two third conductive portions 63*c*, which are in conduction with the first conductive portion 63*a*.

The first conductive portion 63*a* is arranged on the portion of the common electrode 62 disposed on the right side as compared with the plurality of first individual electrodes 60*a*. The first conductive portion 63*a* extends in the conveyance direction over the plurality of first individual electrodes 60*a*. Each of the second conductive portions 63*b* is arranged on the common electrode 62, and each of the second conductive portions 63*b* extends in the scanning direction between the two first individual electrodes 60*a* that adjoin in the conveyance direction. The two third conductive portions 63*c* are connected to the front end portion and the back end portion of the first conductive portion 63*a* respectively. The two third conductive portions 63*c* are arranged at the front side portion and the back side portion of the common electrode 62 as compared with the plurality of individual electrodes 60, and the two third conductive portions 63*c* extend leftward from the first conductive portion 63*a* respectively.

As mentioned above, the electric connecting portion 70 is provided on the upper surface of the left end portion of the upper substrate 46. That is, the electric connecting portion 70 is arranged in the area of the upper surface of the upper substrate 46 overlapped with the manifold 52*b* of the intermediate substrate 47. The electric connecting portion 70 has a plurality of first driving contacts 71*a*, a plurality of second driving contacts 71*b*, and two ground contacts 72.

A plurality of individual traces 73 are connected to the individual electrodes 60 of the plurality of piezoelectric elements 67 respectively. The respective individual traces 73 are led out leftward from the individual electrodes 60, and the respective individual traces 73 extend to the driving contacts 71 of the electric connecting portion 70 provided at the left end portion of the upper substrate 46. As depicted in FIG. 7, a part of the individual trace 73 is arranged on the piezoelectric film 61. The plurality of individual traces 73 are formed of the same material as that of the auxiliary conductor 63 (for example, gold or aluminum).

As depicted in FIGS. 6 and 7A, the first exposed portion 65 of the first individual electrode 60*a* on the right side is exposed from the piezoelectric film 61 in the slit 64 between the two second individual electrodes 60*b*. The right end portion of the first individual trace 73*a* corresponding to the first individual electrode 60*a* is formed continuously from the first exposed portion 65 to the upper surface of the piezoelectric film 61. Further, the first individual trace 73*a* passes between the two second individual electrodes 60*b* in the slit 64 from the first exposed portion 65, and the first individual trace 73*a* extends leftward along with the upper surface of the vibration film 57 of the upper substrate 46. Further, the first individual trace 73*a* climbs over the left end portion of the piezoelectric film 61, and the first individual trace 73*a* is connected to the first driving contact 71*a* of the electric connecting portion 70. Note that the common electrode 62 is formed to have the cutout shape so that the first individual trace 73*a* is avoided in the area between the two second individual electrodes 60*b*. Therefore, no short circuit is formed between the first individual trace 73*a* and the common electrode 62 in the slit 64 of the piezoelectric film 61.

As depicted in FIGS. 6 and 7B, the second exposed portion 66 of the second individual electrode 60*b* on the left side is exposed from the edge on the left side of the piezoelectric film 61. The right end portion of the second individual trace 73*b* corresponding to the second individual electrode 60*b* is formed continuously from the second exposed portion 66 to the upper surface of the piezoelectric film 61. The second individual trace 73*b* extends leftward from the second exposed portion 66 along with the upper surface of the vibration film 57 of the upper substrate 46, and the second individual trace 73*b* is connected to the second driving contact 71*b* of the electric connecting portion 70.

Note that the two third conductive portions 63*c* of the auxiliary conductor 63 described above extend leftward from the first conductive portion 63*a* respectively, and the two third conductive portions 63*c* are connected to the ground contacts 72 of the electric connecting portion 70.

As described above, in this embodiment, the electric connecting portion 70, which has the driving contacts 71 connected to the individual traces 73, is arranged on one side (left side) in the scanning direction with respect to the piezoelectric elements 67 corresponding to the first pressure chambers 51*a* and the piezoelectric elements 67 corresponding to the second pressure chambers 51*b* on the upper substrate 46. Therefore, the first pressure chamber 51*a* and the second pressure chamber 51*b* are arranged while being deviated toward the side (right side) opposite to the driving contact 71 with respect to the center line C of the discharge head 20. Further, the nozzle array 31*a* corresponding to the first pressure chambers 51*a* and the nozzle array 31*b* corresponding to the second pressure chambers 51*b* are also arranged while being deviated toward the side opposite to the driving contacts 71.

As depicted in FIGS. 5 to 7, the piezoelectric actuator 49 described above is covered with a protective member 42 arranged on the upper surface of the upper substrate 46. The protective member 42 has a recessed cover portion 42*a*, and an opening 42*b* that is formed at a left side portion as compared with the cover portion 42*a*. As depicted in FIG. 5, the opening 42*b* of the protective member 42 is vertically communicated with an opening 40*a* of the holder member 40 positioned thereover. When the protective member 42 is arranged on the upper surface of the upper substrate 46, the cover portion 42*a* covers the piezoelectric film 61 of the piezoelectric actuator 49. On the other hand, the electric connecting portion 70 of the upper substrate 46 is exposed from the opening 42*b* of the protective member 42.

COF 35 is connected to the electric connecting portion 70 of the upper substrate 46. As depicted in FIG. 5, COF 35 extends toward the circuit board 34 disposed at the upward position while meandering in an S-shaped form in the opening 42*b* of the protective member 42 and the opening 40*a* of the holder member 40. A through-hole 34*b*, which is positioned over the opening 40*a* of the holder member 40 and which allows COF 35 to pass therethrough, is formed through the circuit board 34. Further, a connecting terminal 75 is provided on the upper surface of the portion of the circuit board 34 disposed on the right side as compared with the through-hole 34*b*. COF 35, which extends upwardly from the contact of the electric connecting portion 70, passes through the through-hole 34*b* of the circuit board 34 positioned on the right side as compared with the contact, and COF 35 is connected to the connecting terminal 75.

Note that various circuit elements 77 for supplying the signal to COF 35 and many traces 78 for connecting the circuit elements 77 and the connecting terminal 75 are arranged around the connecting terminal 75 of the circuit board 34 connected to COF 35. In this case, in this embodiment, the connecting terminal 75 of the circuit board 34 is arranged on the piezoelectric element 67 side (right side) in the scanning direction as compared with the driving contact 71 of the upper substrate 46. Therefore, for example, the trace 78 and the circuit elements 77 connected to the connecting terminal 75 can be arranged in the area of the circuit board 34 overlapped with the piezoelectric element 67. Therefore, it is possible to miniaturize the size of the circuit board 34. Further, the through-hole 34*a*, through which the channel member 41 penetrates, is formed through the circuit board 34 on the side (left side) opposite to the piezoelectric element 67 as compared with the driving contact 71 of the upper substrate 46. Therefore, there are few regions in which, for example, the connecting terminal 75 and the circuit elements 77 connected to the connecting terminal 75 are to be installed, in the area of the circuit board 34 disposed on the left side as compared with the driving contact 71. Also, from this viewpoint, the connecting terminal 75 can be arranged on the side of the piezoelectric element 67 as compared with the driving contact 71.

As depicted in FIG. 5, driver IC 76 is provided at an intermediate portion in the upward-downward direction of COF 35. The driver IC 76 is electrically connected to the circuit board 34 via the trace on COF 35. Further, the driver IC 76 is also electrically connected to the driving contact 71 of the electric connecting portion 70 via the trace on COF 35. Then, the driver IC 76 outputs a driving signal to the individual electrode 60 based on a control signal fed from the circuit board 34 so that the electric potential of the individual electrode 60 is switched between the ground electric potential and a predetermined driving electric potential. Note that the ground contact 72 of the electric connecting portion 70 is electrically connected to the ground (not depicted) of COF 35, and the common electrode 62 is retained at the ground electric potential.

An explanation will be made about the operation of the piezoelectric element 67 to be performed when the driving signal is supplied from the driver IC 76. In the state in which the driving signal is not supplied, the electric potential of the individual electrode 60 is the ground electric potential, and the electric potential is the same electric potential as that of the common electrode 62. Starting from this state, when the driving signal is supplied to a certain individual electrode 60, and the driving electric potential is applied to the individual electrode 60, then the electric field, which is parallel to the thickness direction, acts on the active portion 61*a* of the piezoelectric element 67 in accordance with the difference in the electric potential between the individual electrode 60 and the common electrode 62. In this situation, the direction of polarization of the active portion 61*a* is coincident with the direction of the electric field. Therefore, the active portion 61*a* is elongated in the thickness direction as the direction of polarization thereof, and the active portion 61*a* is shrunk in the in-plane direction (surface direction). In accordance with the shrinkage deformation of the active portion 61*a*, the vibration film 57 is warped or flexibly bent so that the vibration film 57 protrudes toward the pressure chamber 51. Accordingly, the volume of the pressure chamber 51 is decreased, and the pressure wave is generated in the pressure chamber 51. Thus, the liquid droplets of the ink are discharged from the nozzle 30 communicated with the pressure chamber 51.

In the embodiment of the present teaching explained above, the substrate (upper substrate 46), on which the first pressure chambers 51 and the second pressure chambers 51 of each of the discharge heads 20 are formed, is distinct from the substrate (intermediate substrate 47) on which the manifolds 52 communicated with the pressure chambers 51 are formed. Therefore, the width of the upper substrate 46 in the scanning direction can be decreased by the amount corresponding to the manifolds 52 not formed thereon. Further, both of the individual traces 73 led out from the piezoelectric elements 67 corresponding to the first pressure chambers 51 and the individual traces 73 led out from the piezoelectric elements 67 corresponding to the second pressure chambers 51 are led out toward the driving contacts 71 of the electric connecting portion 70 arranged on one side (left side) in the scanning direction with respect to the piezoelectric elements 67. In other words, the driving contacts 71, which are connected to COF 35, are not arranged between the first pressure chambers 51 and the second pressure chambers 51. Therefore, the first pressure chambers 51 and the second pressure chambers 51 can be approximated to one another, and it is possible to narrow the distance between the two nozzle arrays 31 in the scanning direction. Further, it is possible to provide such a state that the lower substrate 48 is not overlapped with the electric connecting portion 70 of the upper substrate 46. Accordingly, it is possible to decrease the width of the lower substrate 48 in the scanning direction.

Further, in this embodiment, as depicted in FIG. 2, the electric connecting portion 70, which has the plurality of contacts 71, is arranged on one side (left side) in the scanning direction with respect to the first pressure chambers 51 and the second pressure chambers 51 on the upper substrate 46 of each of the discharge heads 20. Owing to this structure, the first nozzle array 31*a* corresponding to the first pressure chambers 51 and the second nozzle array 31*b* corresponding to the second pressure chambers 51 are arranged while being deviated toward the side (right side) opposite to the electric connecting portion 70 in the scanning direction.

Further, the two nozzle arrays 31 are arranged while being deviated toward the outer side in the two discharge heads 203, 204 of the ink-jet head 4 positioned on the outer side. Accordingly, it is possible to increase the distance between the nozzle arrays 31 in relation to the two discharge heads 20 disposed on the outer side.

Further, in this embodiment, as depicted in FIG. 2, the two nozzle arrays 31 are arranged while being deviated toward the inner side in each of the two discharge heads 201, 202 arranged on the inner side, of the four discharge heads 20 of the ink-jet head 4, and the two nozzle arrays 31 are arranged while being deviated toward the outer side in each of the two discharge heads 203, 204 arranged on the outer side. Accordingly, it is possible to increase the distance between the nozzle arrays 31 of the inner side discharge head 201 (202) for discharging the black and magenta inks and the nozzle arrays 31 of the outer side discharge head 203 (204) for discharging the cyan and yellow inks.

When the distance is increased between the nozzle arrays 31 of the inner side discharge head 20 and the nozzle arrays 31 of the outer side discharge head 20, the problem, in which the two types of ink adhere in a mixed state in relation to the respective nozzles 30, hardly arises. For example, as depicted in FIG. 3, when the suction purge is performed while covering the nozzle arrays 31 of the four discharge heads 20 with the cap 21, the ink of black and magenta discharged from the inner side nozzles 30 hardly adhere to the nozzles 30 of the outer side discharge head 20. Further, such a situation hardly arises as well that the ink of black and magenta discharged from the inner side nozzles 30 are formed into a mist that adheres to the nozzles 30 of the outer side discharge head 20 during the recording of an image or the like on the recording paper 100.

Further, the influence, which is exerted on the printing quality, is extremely large when the nozzles 30*y* for discharging the yellow ink are contaminated with the black ink. In view of the above, one of the black ink and the yellow ink can be discharged from the inner side discharge head 201 (202), and the other can be discharged from the outer side discharge head 203 (204). This embodiment is constructed such that the black ink is discharged from the inner side discharge head 201 (202), and the yellow ink is discharged from the outer side discharge head 203 (204).

In the embodiment explained above, the ink-jet printer 1 corresponds to the "liquid discharge apparatus" according to the present teaching. One discharge head 20 of the ink-jet head 4 corresponds to the "liquid discharge head" according to the present teaching. The front-rear direction (conveyance direction) corresponds to the "first direction" according to the present teaching, and the left-right direction (scanning direction) corresponds to the "second direction" according to the present teaching. The two discharge heads 20 positioned on the inner side of the four discharge heads 20 of the ink-jet head correspond to the "inner liquid discharge head" according to the present teaching, and the two discharge heads 20 positioned on the outer side correspond to the "outer liquid discharge head" according to the present teaching. The black and magenta inks discharged from the inner side discharge heads 20 correspond to the "first liquid" according to the present teaching, and the cyan and yellow inks discharged from the outer side discharge heads 20 correspond to the "second liquid" according to the present teaching.

Next, an explanation will be made about modified embodiments in which various modifications are applied to the embodiment described above. However, those constructed in the same manner as those of the embodiment described above are designated by the same reference numerals, any explanation of which will be appropriately omitted.

Figure 8:
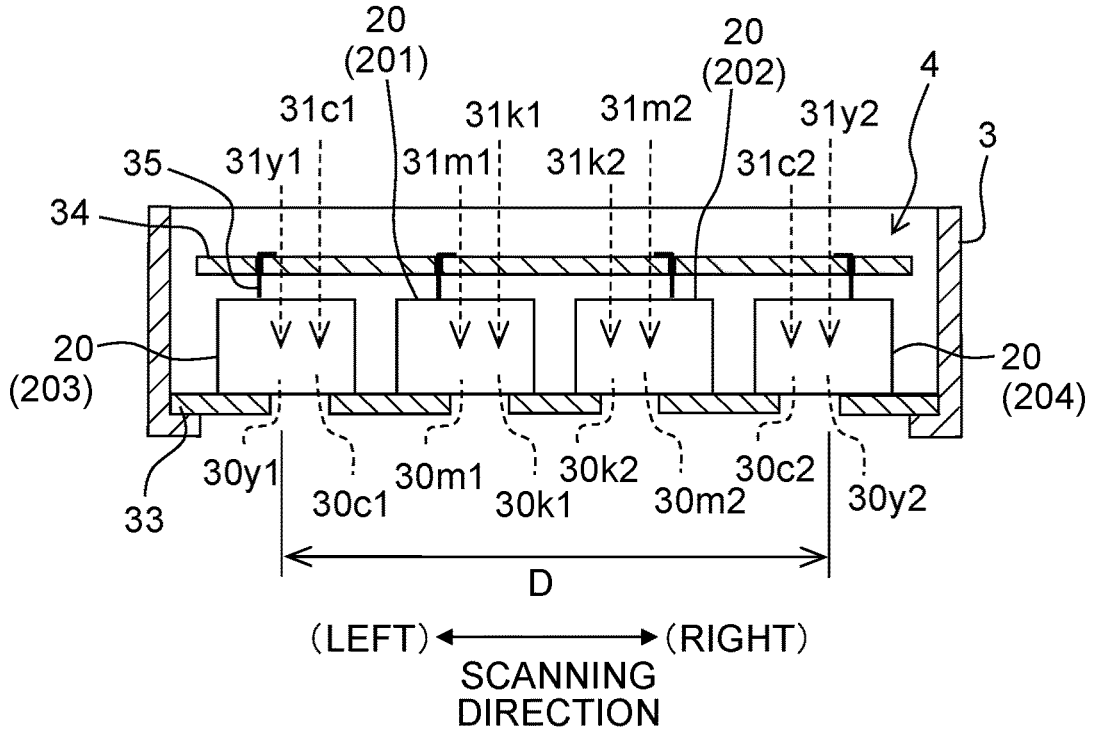
FIG. 8 depicts a sectional view illustrating a carriage according to a modified embodiment.

As depicted in FIG. 8, the nozzle arrays 31 of the two discharge heads 20, which are positioned on the outer side and which are included in the four discharge heads 20 of the ink-jet head 4, may be arranged while being deviated toward the inner side in the scanning direction. That is, the two nozzle arrays 31 are deviated toward the right side in the discharge head 203 positioned on the left end, and the two nozzle arrays 31 are deviated toward the left side in the discharge head 204 positioned on the right end. Accordingly, it is possible to decrease the distance D between the nozzle arrays 31 in relation to the two discharge heads 203, 204 positioned on the outer side. In the case of this structure, the distance D in the scanning direction is decreased between the nozzle array 31 positioned at the left end and the nozzle array 31 positioned at the right end of the ink-jet head 4. Therefore, the following effects are obtained.

The smaller the distance D between the nozzle array 31 positioned at the left end and the nozzle array 31 positioned at the right end is, the more shortened the distance of movement in one path can be, when the printing is performed on the recording paper 100 while reciprocatively moving the ink-jet head 4 in the scanning direction. Accordingly, the time required for one path is shortened, and the time required for the printing on one sheet of the recording paper 100 is shortened as well.

It is ideal that the respective discharge heads 20 of the ink-jet head 4 are attached so that the arrangement direction of the nozzles 30 (extending direction of the nozzle array 31) is completely parallel to the conveyance direction. However, actually, the respective discharge heads 20 are attached in many cases as well in such a state that the arrangement direction of the nozzles 30 is slightly inclined with respect to the conveyance direction. In such a situation, the landing positions of the liquid droplets of the inks discharged from the nozzles 30 are deviated in the conveyance direction between the two nozzle arrays 31 resulting from the inclination as described above. In this case, the deviation of the landing position between the two nozzle arrays 31 depends on the distance in the scanning direction between the two nozzle arrays 31. That is, in this embodiment, the distance D in the scanning direction is decreased between the nozzle array 31 positioned at the left end and the nozzle array 31 positioned at the right end, and thus it is possible to decrease the deviation of the landing position of the ink between the two nozzle arrays 31.

Figure 9:
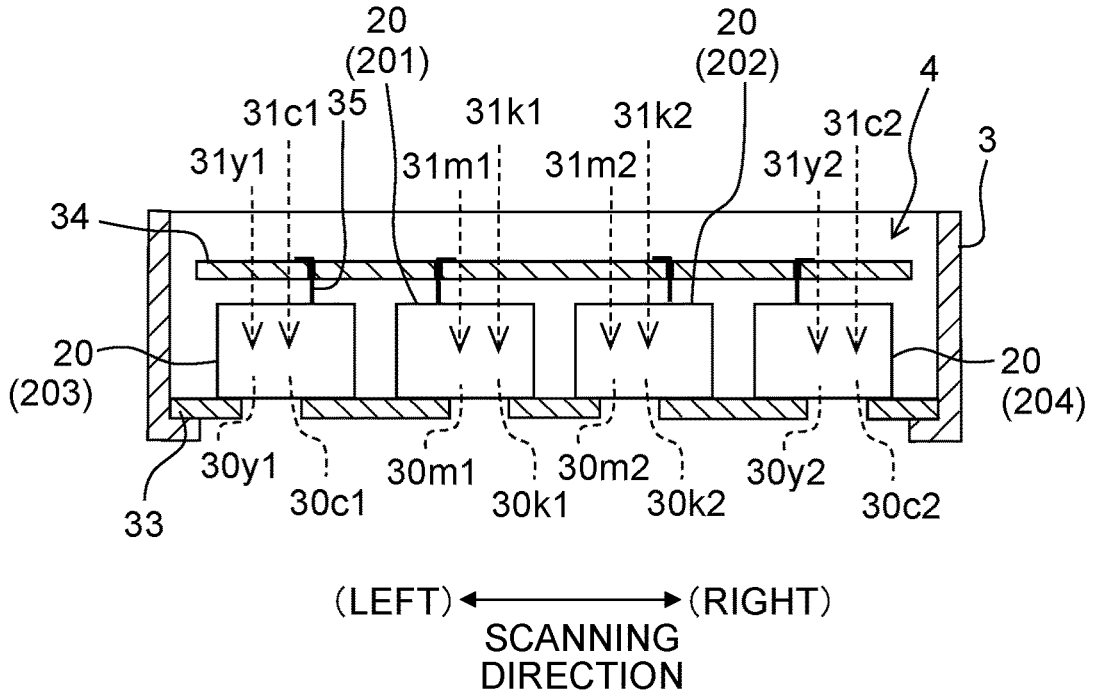
FIG. 9 depicts a sectional view illustrating a carriage according to another modified embodiment.

In the embodiment described above, the nozzle arrays 31 for discharging the four colors of ink respectively are arranged in left-right symmetry. However, the present teaching is not limited to the arrangement as described above. For example, as depicted in FIG. 9, the nozzle array 31*m* for the magenta ink may be arranged on the left side, and the nozzle array 31*k* for the black ink may be arranged on the right side, in both of the discharge head 201 and the discharge head 202 positioned on the inner side. In other words, it is also allowable to adopt such a structure that the nozzle arrays 31*m*1, 31*m*2 for the magenta and the nozzle arrays 31*k*1, 31*k*2 for the black are alternately aligned in the scanning direction in the two discharge heads 201, 202. The discharge head 203 and the discharge head 204 positioned on the outer side may be constructed in the same manner. For example, as depicted in FIG. 9, it is also allowable to adopt such a structure that the nozzle array 31*y* for the yellow is arranged on the left side, and the nozzle array 31*c* for the cyan is arranged on the right side.

The number of the discharge heads 20 of the ink-jet head 4 is not limited to four. For example, it is also allowable that the number of the discharge heads 20 is two or three. It is also allowable that the number of the discharge heads 20 is five or more. For example, when ink of other colors such as light magenta, light cyan and the like are discharged in addition to the black, magenta, cyan, and yellow, it is also allowable that the two discharge heads 20, which discharge the ink of two colors of light magenta and light cyan, are arranged respectively on the both sides in the scanning direction of the four discharge heads 201 to 204. Further, it is also allowable that the discharge head 20, which discharges another ink (for example, white ink), is arranged between the discharge head 201 and the discharge head 202 disposed on the inner side.

In the embodiment described above, the two nozzle arrays 31 of the respective discharge heads 20 discharge the ink of the different types. However, it is also allowable to adopt such a structure that the two nozzle arrays 31 of one discharge head 20 discharge the ink of the same type. Further, it is also allowable to adopt such a structure that the plurality of discharge heads 20 discharge the ink of the same type.

The ink-jet head 4 of the embodiment described above is the ink-jet head of the so-called serial type in which the inks are discharged onto the recording paper while moving in the scanning direction. However, the present teaching can be also applied to an ink-jet head of the line type, which is used while being fixedly installed at a predetermined position.

Figure 10:
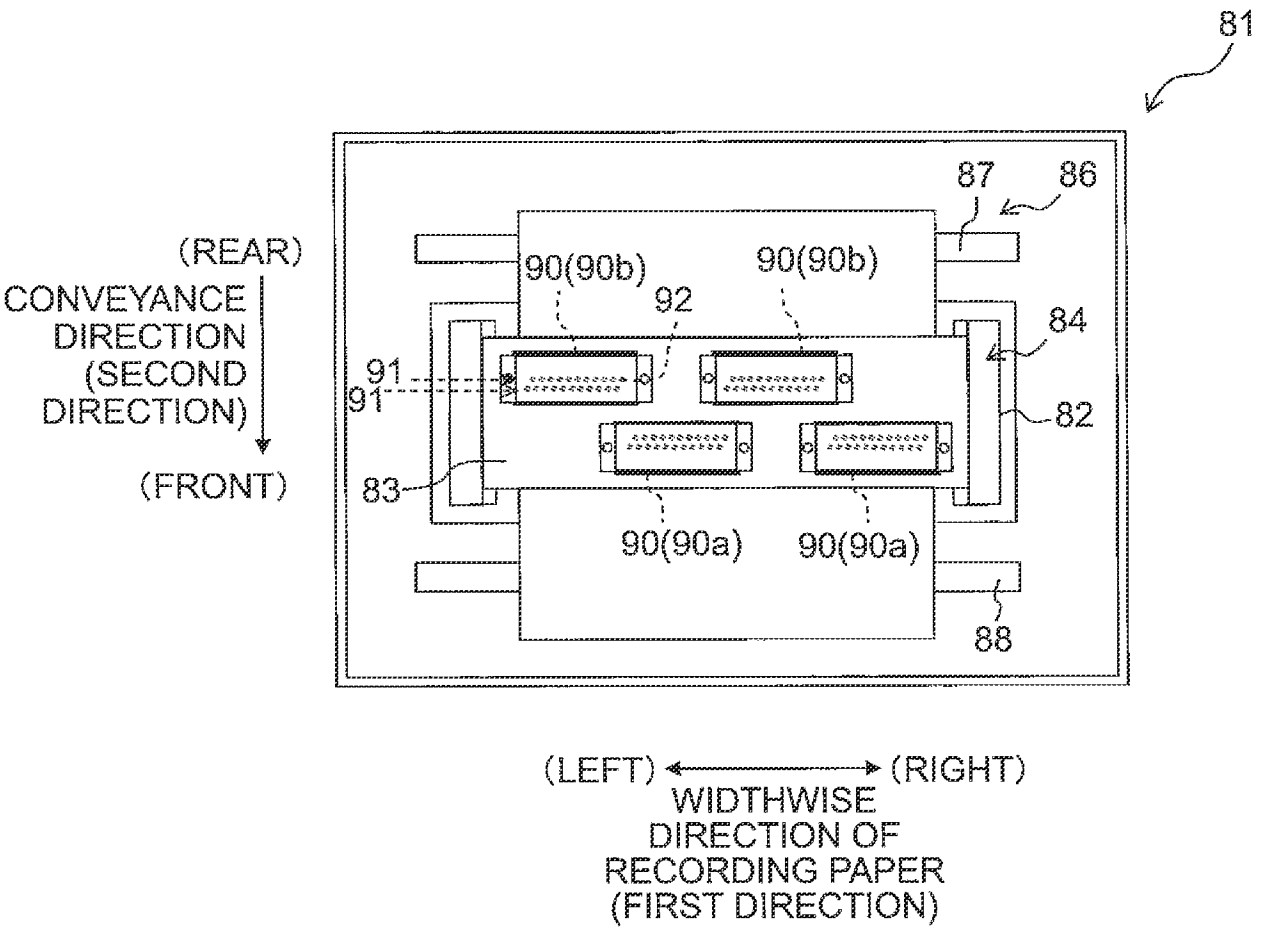
FIG. 10 depicts a schematic top view illustrating a printer according to still another modified embodiment.

An ink-jet printer 81 depicted in FIG. 10 includes an ink-jet head 84 of the line type, and a conveyance mechanism 86 including two conveyance rollers 87, 88. The ink-jet head 84 has four discharge heads 90 that are attached to a head holder 83. The discharge head 90 has a plurality of nozzles 92 which are arranged in the left-right direction (widthwise direction of the recording paper). The plurality of nozzles 92 constitute two nozzle arrays 91 that are aligned in the front-rear direction (conveyance direction).

In the case of the ink-jet head 84, the nozzle arrays, which are longer in the widthwise direction of the recording paper than the nozzle arrays 91 of one discharge head 90, are formed by combining the four discharge heads 90. Note that if the four discharge heads 90 are merely simply connected in the widthwise direction of the recording paper, any portion, in which the nozzles 92 are not arranged in the widthwise direction of the recording paper, appears between the discharge heads 90. Therefore, two of the four discharge heads 90 are arranged at each of front and rear positions while being classified. The two discharge heads 90*a* disposed on the front side and the two discharge head 90*b* disposed on the rear side are arranged while being deviated in the left-right direction. The four discharge heads 90 of the ink-jet head 84 discharge the ink from the nozzles 92 onto the recording paper 100 that is conveyed frontward by the two conveyance rollers 87, 88 of the conveyance mechanism 86.

Further, the two nozzle arrays 91 of each of the discharge heads 90 are arranged while being deviated toward the inner side in the front-rear direction. That is, the nozzle arrays 91 are arranged while being deviated toward the rear side in the two discharge heads 90*a* positioned on the front side. The nozzle arrays 91 are arranged while being deviated toward the front side in the two discharge heads 90*b* positioned on the back side. Therefore, it is possible to decrease the distance between the nozzle arrays 91 in relation to the discharge heads 90 aligned in the front-rear direction. Accordingly, even when the ink-jet head 84 is attached such that the arrangement direction of the nozzles is slightly inclined with respect to the left-right direction, the deviation of the landing position of the ink is suppressed to be small between the nozzle arrays 91 owing to the fact that the distance between the nozzle arrays 91 is small in relation to the front and rear discharge heads 90. Note that in the embodiment depicted in FIG. 10, the recording paper 100 corresponds to the "medium" according to the present teaching. The widthwise direction of the recording paper (left-right direction) corresponds to the "first direction" according to the present teaching, and the front-rear direction (conveyance direction) corresponds to the "second direction" according to the present teaching.

In the embodiment and the modified embodiments thereof explained above, the present teaching is applied to the ink-jet head which discharges the ink onto the recording paper to print, for example, an image. However, the present teaching is also applicable to any liquid discharge apparatus that is used in various ways of use other than the printing of the image or the like. For example, the present teaching can be also applied to a liquid discharge apparatus that discharges a conductive liquid onto a substrate to form a conductive pattern on the surface of the substrate.

What is claimed is:

1. A liquid discharge head, comprising:

a nozzle defining member including a plurality of nozzle arrays, each of the nozzle arrays including a plurality of nozzles aligned in a first direction, and the nozzle arrays being arranged side by side in a second direction intersecting with the first direction;

a channel defining member defining a channel in communication with the nozzles;

a connecting part including a plurality of contacts located on the channel defining member;

a trace member electrically connected with the contacts;

a plurality of energy generating elements overlapping with the nozzles, respectively, in a third direction orthogonal to the first direction and the second direction; and a film covering the channel, wherein the plurality of nozzle arrays includes a nozzle array A that is nearest to the contacts in the second direction and a nozzle array B that is furthest from the contacts in the second direction, wherein the channel defining member includes a first end and second end which are both ends of the channel defining member in the second direction, wherein the nozzle defining member is stacked on the channel defining member in the third direction, wherein the contacts are located between the first end and the nozzle array A in the second direction, wherein none of the contacts are located between the second end and the nozzle array B in the second direction, and wherein the connecting part is located nearer to the first end than the second end in the second direction.

2. The liquid discharge head according to claim 1, wherein the channel includes a manifold, and wherein the manifold includes: a first manifold connected to the nozzles of the nozzle array A, and a second manifold connected to the nozzles of the nozzle array B.

3. The liquid discharge head according to claim 2, wherein the film covers the manifold.

4. The liquid discharge head according to claim 2, wherein the film includes a first film area covering the first manifold and a second film area covering the second manifold.

5. The liquid discharge head according to claim 4, wherein the first film area overlaps with the connecting part in the third direction, and wherein the second film area does not overlap with the connecting part in the third direction.

6. The liquid discharge head according to claim 5, wherein the connecting part is located at an opposite side of the film in the third direction.

7. The liquid discharge head according to claim 1, wherein the connecting part overlaps with the film in the third direction.

8. The liquid discharge head according to claim 1, wherein the film is made of a resin.

9. The liquid discharge head according to claim 1, further comprising a plate covering the film.

10. The liquid discharge head according to claim 9, wherein the film is thinner than the plate.

* * * * *